United States Patent [19]

Hemsley et al.

[11] Patent Number: 4,889,287

[45] Date of Patent: Dec. 26, 1989

[54] JET SPRAY SPRINKLER

[75] Inventors: Stephen T. Hemsley, Murray Bridge; Bogdan Roszowski, Reynella, both of Australia

[73] Assignee: James Hardie Building Products Pty. Limited, New South Wales, Australia

[21] Appl. No.: 175,042

[22] PCT Filed: May 4, 1988

[86] PCT No.: PCT/AU87/00128

§ 371 Date: Jan. 5, 1988

§ 102(e) Date: Jan. 5, 1988

[87] PCT Pub. No.: WO87/06859

PCT Pub. Date: Nov. 19, 1987

[30] Foreign Application Priority Data

May 6, 1986 [AU] Australia ..... PH5763

[51] Int. Cl.[4] ..... B05B 1/34

[52] U.S. Cl. ..... 239/498; 239/499; 239/504; 239/523

[58] Field of Search ..... 239/DIG. 1, 498, 499, 239/502, 504, 505, 512, 518, 524

[56] References Cited

U.S. PATENT DOCUMENTS

| | | | |
|---|---|---|---|
| 1,727,111 | 9/1929 | Moore | 239/498 X |
| 1,805,782 | 5/1931 | Munz | 239/498 |
| 3,245,540 | 4/1966 | Johnson | 239/504 X |
| 3,416,735 | 12/1968 | Reed | 239/498 |
| 3,454,225 | 7/1969 | Hunter | 239/498 X |
| 3,815,831 | 6/1974 | Joostie | 239/498 |
| 4,199,105 | 4/1980 | Olson et al. | 239/498 |
| 4,284,241 | 8/1981 | Azalbert | 239/499 X |
| 4,391,410 | 7/1983 | Smith | 239/498 |
| 4,401,273 | 8/1983 | Olson | 239/498 |
| 4,569,485 | 2/1986 | Walto | 239/498 X |

FOREIGN PATENT DOCUMENTS

| | | | |
|---|---|---|---|
| 459874 | 7/1972 | Australia . | |
| 475112 | 9/1975 | Australia . | |
| 139693 | 1/1980 | German Democratic Rep. | 239/518 |
| 817998 | 8/1959 | United Kingdom . | |

*Primary Examiner*—Andres Kashnikow

[57] ABSTRACT

An irrigation sprinkler having a body to which is fitted a cap. Water issues from a nozzle in the body to impinge on the end of the cap, the end of the cap having an internal surface formed by revolution of an arc about the axis of the cap. Apertures are formed by serrations in the curved surface opening through a conical surface in the end of the cap.

5 Claims, 2 Drawing Sheets

JET SPRAY SPRINKLER

This invention relates to a jet spray sprinkler more particularly to a jet spray sprinkler of the type commonly of small dimensions.

DESCRIPTION OF PRIOR ART

One particular type of sprinkler is disclosed in U.S. Pat. No. 3,815,831 and Australian Patent No. 459,874. Such a sprinkler comprises a body, a passage through the body having an inlet and outlet end, means associated with the inlet end for connecting it to a supply source of water, and a distribution cap located over the outlet end. The cap has a skirt extending away from the body, a closed end remote from the body and a series of outlet perforations through the wall of the cap, the series extending at least part way around the periphery of the cap. The cap where the water impinges on the end thereof has an at least part conical surface with the apex of the conical surface directed towards the outlet end of the passage, and the longitudinal axis of the conical surface being in line with the longitudinal axis of the outlet end. The perforations are formed by an external step decrease in diameter of the cap combined with a riffling or serrating of the inner surface of the closed end of the cap so that the troughs of the serrations or riffles and the said external step decrease defines the perforations, with the peaks of the serrations or riffles connecting the said end of the skirt.

Australian Patent No. 475,112 shows a similar sprinkler but the cap is freely rotatable, and the perforations are shaped such that the water flow through the perforations causes rotation of the cap.

Other types of sprinklers are known but these are of the open type, i.e. they do not utilise a cap to enclose the jet or nozzle. In these instances the jet or nozzle is exposed, with the jet impinging on an anvil supported above the jet or nozzle.

It is an object of the invention to provide a jet spray sprinkler which has an improved performance and also ease of manufacture.

BRIEF STATEMENT OF THE INVENTION

Thus there is provided according to the invention, a sprinkler having a body having an inlet end and an outlet end with a passage therethrough, means for connecting the inlet end to a source of water supply, and a distribution cap on the sprinkler extending over the outlet end of the passage, the cap having a skirt to engage the body and extend away from the body, the cap at its upper end having on its outer surface a conical shape tapering toward the closed end of the cap, the interior of the closed end of the cap having a surface of revolution defined by rotating a curve around the axis of the cap, perforations which extend at least part way around the cap being defined by the conical shape of the external wall combined with serrating the inner surface of the surface of revolution adjacent the external wall.

BRIEF DESCRIPTION OF THE DRAWINGS

In order to more fully describe the invention, reference will now be made to the accompanying drawings in which.

DESCRIPTION OF THE PREFERRED EMBODIMENT

Figure 1:
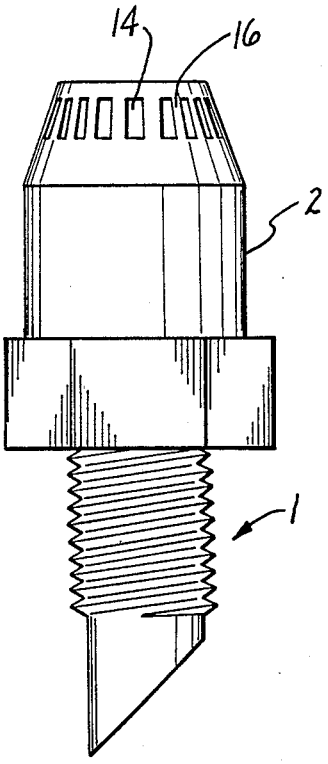
FIG. 1 is a side elevation of a sprinkler showing the body with the cap fitted thereto.
Figure 2:
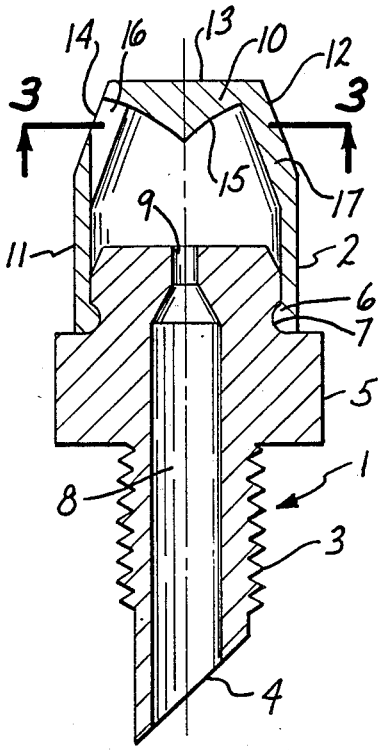
FIG. 2 is a cross-sectional view of the body and the cap.
Figure 3:
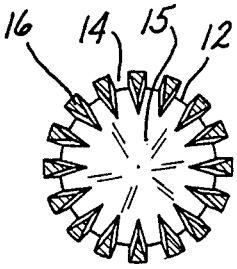
FIG. 3 is a sectional view along the lines 3—3 of FIG. 2.

Referring firstly to FIGS. 1 to 3, the sprinkler comprises a body 1 and a cap 2, the body 1 having an extension 3 which is threaded and has an inclined end 4 to facilitate insertion into an aperture formed in a supply pipe of plastics material.

The body 1 preferably has a hexagonal portion 5 to facilitate the insertion into the tube of plastics material by a suitable tool, the body adjacent the hexagonal portion on the side opposite to the extension 3, having a peripheral groove 6 into which the cap 2 is adapted to be snap-fitted, the cap 2 having an internal bead 7 to engage in the peripheral groove.

The body of the sprinkler has a longitudinal passage 8 therethrough, the passage 8 terminating in a small aperture 9 forming the jet of water to impinge on the closed end 10 of the cap.

The cap 2 has a peripheral skirt 11 and towards its upper end has an external conical surface 12 extending toward the top surface 13 of the cap. A series of perforations 14 are formed in the conical surface 12, the perforations extending at least part way around the periphery of the conical surface, the extension of the perforations depending upon the angular area to be watered by the sprinkler.

The internal surface of the top 10 of the cap is defined as a curved surface 15 formed by rotating a curve around the axis of the sprinkler, the axis being directed toward the jet 9 in the body.

The perforations are formed through the conical surface of the cap, the perforations through this wall being formed between ribs 16 which support the top of the cap from the skirt 11. The portion indicated 17 is shown as a section through one of the ribs 16. The inner surface of the ribs 16 extend from the edge portion of the curved surface 15 to the internal side wall of the skirt below the perforations 14.

Thus the perforations are formed through the wall of the cap and are defined by the conical shape of the external wall combined with the serrations of the inner surface adjacent the external wall surface.

By the internal surface of the closed end of the cap having a surface of revolution defined by rotating a curve it will be seen that an improved performance is obtained due to the water smoothly flowing over this curved surface thus reducing water pressure loss inside the cap, thus increasing the watering radius.

By forming the cap with a conical shape and forming the perforations or apertures in the conical wall, this allows for easy and exact control over the shape of the perforations.

These perforations are shown in FIG. 1 as being rectangular but it is to be realized that they can be of other shapes such as triangular or trapezoidal depending upon an angle between the external wall and the internal serrations.

Figure 4:
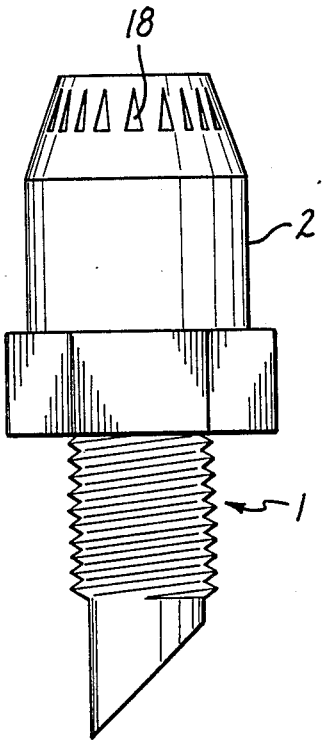
FIG. 4 shows a side elevation of a further form of the invention.
Figure 5:
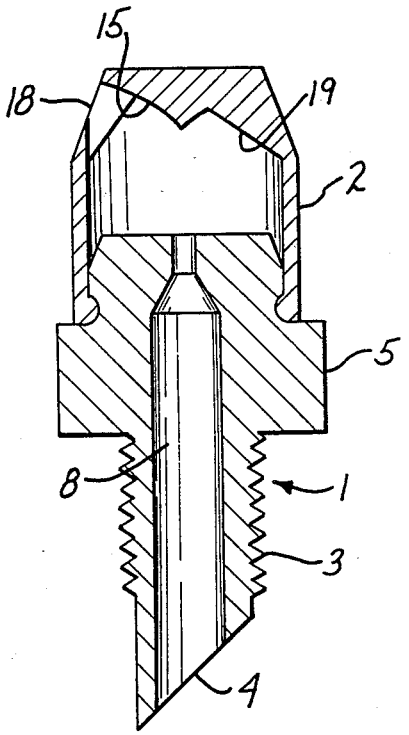
FIG. 5 is a cross-sectional view of the embodiment of FIG. 4.

Turning now to FIG. 4, a further embodiment is shown, again having curved inner surface 15 but with the serrations being formed as triangular, it being noted that the internal edge 19 of the ribs 20 is of greater angle than that shown in FIG. 2.

Thus there is provided according to the invention, an improved sprinkler which allows for ease and exact control over the shape of the perforations and has improved performance due to reduced pressure loss within the cap itself.

Although various forms of the invention have been described in some detail it is to be realized that the invention is not to be limited thereto but can include various modifications falling within the spirit and scope of the invention.

The claims defining the invention are as follows:

1. A sprinkler having a body formed about an axis, an inlet end at one end of the body and an outlet end at the opposite end of the body, a passage axially through the body, means for connecting the inlet end to a source of water supply, a nozzle at the outlet end, a distribution cap having an open end and a closed end fitting over the outlet end by a skirt engaging the body, the outer surface of the cap having a conical shape defined about the axis of the body and tapering towards the closed end of the cap, the interior of the closed end of the cap being formed of a surface of revolution defined by rotating a curve around the said axis of the cap, and perforations which extend at least part way around the cap being defined by the conical shape of the external wall combined with serrating the surface of revolution afjacent the external wall, the surface of revolution defining a cusp axially of the cap about the said axis, said cusp extending from said axis toward said perforations, and the surface of revolution smoothly curving progressively toward the closed end of the cap throughout the full length of the surface of revolution.

2. A sprinkler as defined in claim 1, wherein the end outer surface of the closed end of the cap is planar, and the conical surface terminates at the planar end.

3. A sprinkler as defined in claim 2, wherein the apertures are separated by ribs, the ribs being formed by the ends of the ridges of the serrations.

4. A sprinkler as defined in claim 3, wherein said apertures are triangular.

5. A sprinkler as defined in claim 3, wherein said apertures are rectangular.

* * * * *